US005117644A

United States Patent [19]

Fought

[11] Patent Number: 5,117,644

[45] Date of Patent: Jun. 2, 1992

[54] CONDENSER COIL COOLING APPARATUS

[76] Inventor: Billy L. Fought, 4414 Halls Ferry Road, Vicksburg, Miss. 39180

[21] Appl. No.: 643,897

[22] Filed: Jan. 22, 1991

[51] Int. Cl.[5] ..... F28D 3/00

[52] U.S. Cl. ..... 62/171; 62/183; 62/506

[58] Field of Search ..... 62/183, 171, 506

[56] References Cited

U.S. PATENT DOCUMENTS

| | | | |
|---|---|---|---|
| 2,664,715 | 1/1954 | Borgerd | 62/184 |
| 3,540,229 | 11/1970 | Bunten | 62/506 |
| 3,613,392 | 10/1971 | Ditucci | 62/171 |
| 4,170,117 | 10/1979 | Faxon | 62/183 |
| 4,213,306 | 7/1980 | Peabody et al. | 62/85 |
| 4,240,265 | 12/1980 | Faxon | 62/171 |
| 4,266,406 | 5/1981 | Ellis | 62/183 |
| 4,494,384 | 1/1985 | Lott | 62/279 |
| 4,542,627 | 9/1985 | Welker | 62/171 |
| 4,576,012 | 3/1986 | Luzenberg | 62/157 |
| 4,685,308 | 8/1987 | Welker et al. | 62/171 |

*Primary Examiner*—Ronald C. Capossela

[57] ABSTRACT

An air conditioning condenser cooling device is characterized by a unique valve assembly which delivers a spray mist to the coils of the condenser only while the condenser is operating. A vibration transducer is provided which senses vibrations of the condenser when the condenser is in operation. The transducer produces a signal which opens a valve to supply fluid such as water from a fluid supply to a spray nozzle adjacent the condenser coils. When the condenser is off and thus not vibrating, the valve closes and the spray is terminated.

8 Claims, 3 Drawing Sheets

FIG. 1
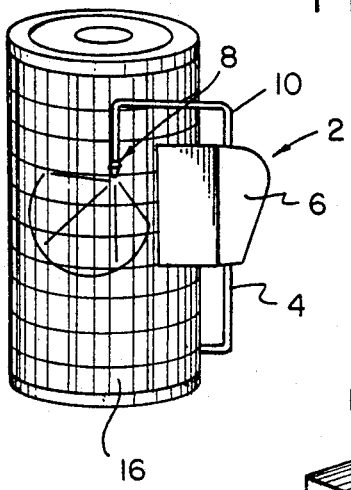
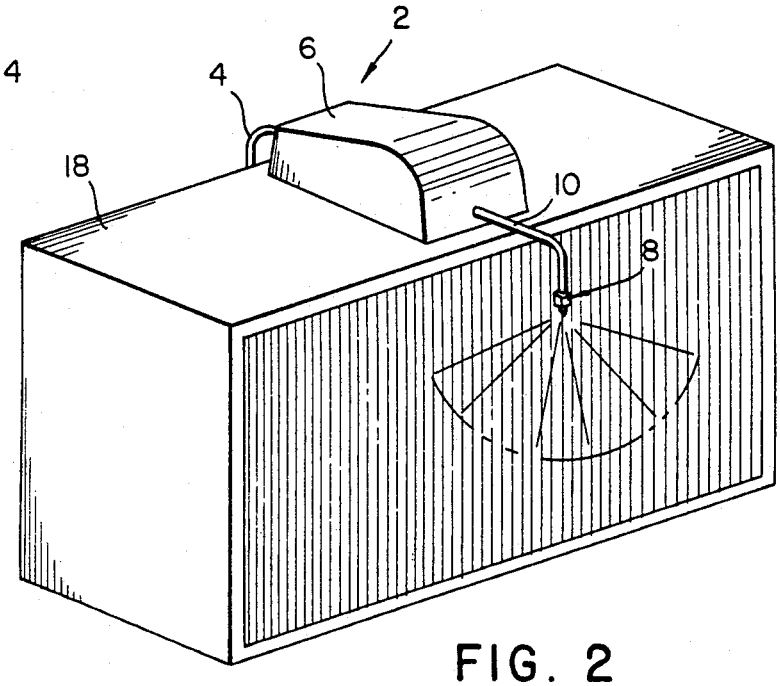
FIG. 2
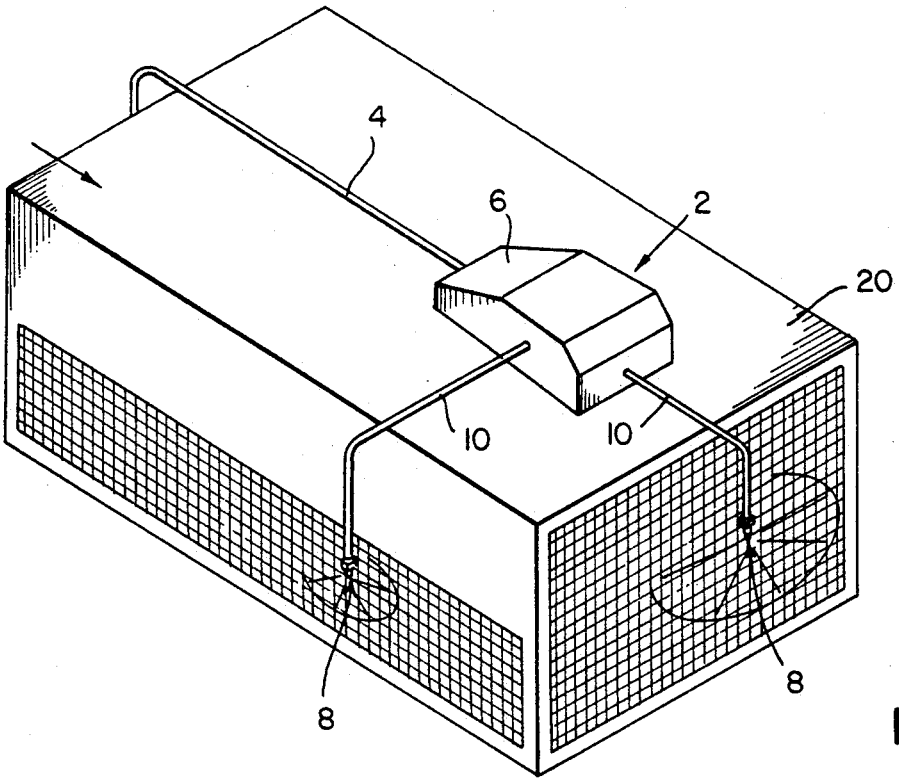
FIG. 3

FIG. 4
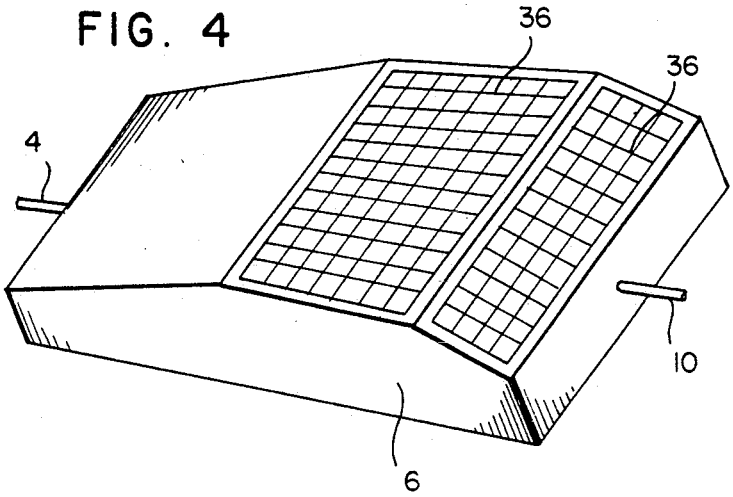
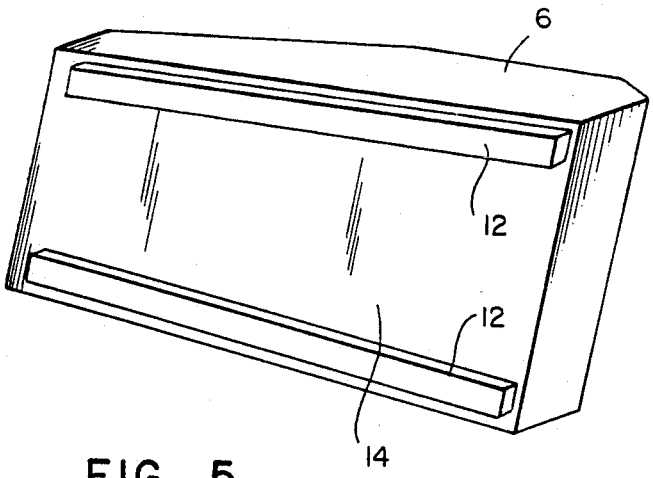
FIG. 5
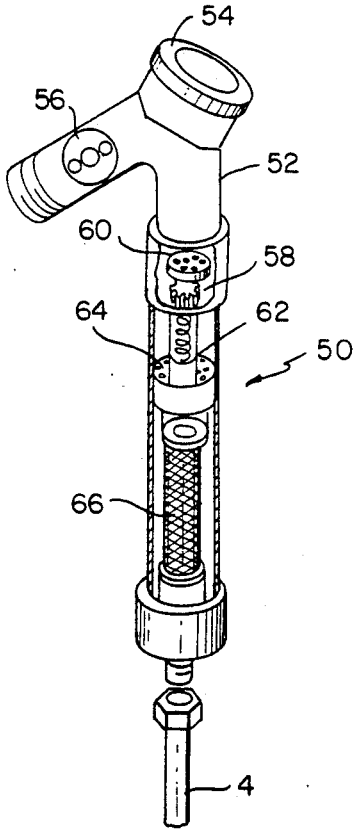
FIG. 7

CONDENSER COIL COOLING APPARATUS

BACKGROUND OF THE INVENTION

Residential and commercial air conditioners include a condenser arranged externally of the building being cooled. A refrigerant is circulated through a coil in the condenser for heat exchange. During operation of the condenser, the coils become quite warm. The hotter the coils, the harder and longer the condenser must operate to cool the building. The present invention relates to a simple device for cooling the condenser coils by spraying a fine mist of water thereon during condenser operation.

BRIEF DESCRIPTION OF THE PRIOR

Air conditioning condenser unit cooling devices are well-known in the patented prior art as evidenced by the U.S. patents to Welker U.S. Pat. No. 4,542,627, Welker et al U.S. Pat. No. 4,685,308 and Faxon U.S. Pat. No. 4,170,117 and U.S. Pat. No. 4,240,265. The Welker et al patent U.S. Pat. No. 4,685,308, for example, discloses a temperature responsive air conditioner cooling apparatus which sprays water over the air conditioner coils. The apparatus uses a non-electrical temperature responsive valve for controlling the flow of the cooling water. A water treatment device is also provided which filters the nonevaporative components of the water before it is sprayed on the coils. The Faxon devices are also temperature responsive so that a spray mist is applied to the coils and fins of an air conditioner condenser only when predetermined temperature conditions exist.

While the prior devices normally operate satisfactorily, the fact that they are temperature responsive limits their effectiveness. Moreover, such devices have a tendency to spray the coils when the condenser is not in use, particularly if the ambient air temperature is above the threshold of the device. This results in waste of water and damage to the surrounding environment.

SUMMARY OF THE INVENTION

Accordingly, it is a primary object of the present invention to provide an apparatus for cooling the coils of an air conditioning condenser including a fluid supply and a spray nozzle connected with the fluid supply and arranged adjacent the coils for spraying a fluid mist thereon. A valve is arranged between the fluid supply and the nozzle and is operable between open and closed positions to deliver and interrupt the flow of fluid from the supply. A valve control circuit is connected with the valve for opening the valve when the condenser is operating and for closing the valve when the condenser is not operating.

The valve control circuit is operated by a portable power source such as a battery, a solar collector or a combination of the two. The circuit includes a vibration transducer which senses vibrations of the condenser when the condenser is operating and produces control signals in response to the sensed vibrations. A pulse circuit is connected with the transducer and produces switching pulses used to open the valve when vibrations are sensed and to close the valve when vibrations are terminated.

BRIEF DESCRIPTION OF THE FIGURES

Other objects and advantages of the invention will become apparent from a study of the following specification when viewed in the light of the accompanying drawing, in which:

FIGS. 1 and 2 are perspective views illustrating the condenser coil cooling apparatus of the present invention mounted on differently configured condensers;

FIG. 3 is a perspective view of the condenser coil cooling apparatus of the invention including a plurality of spray nozzles for cooling large size condensers;

FIGS. 4 and 5 are top and bottom perspective views, respectively, of the housing of the cooling apparatus;

FIG. 7 is a partial cutaway view of a filter and fluid pressure reducing device for use with the cooling apparatus.

DETAILED DESCRIPTION

Figure 6:
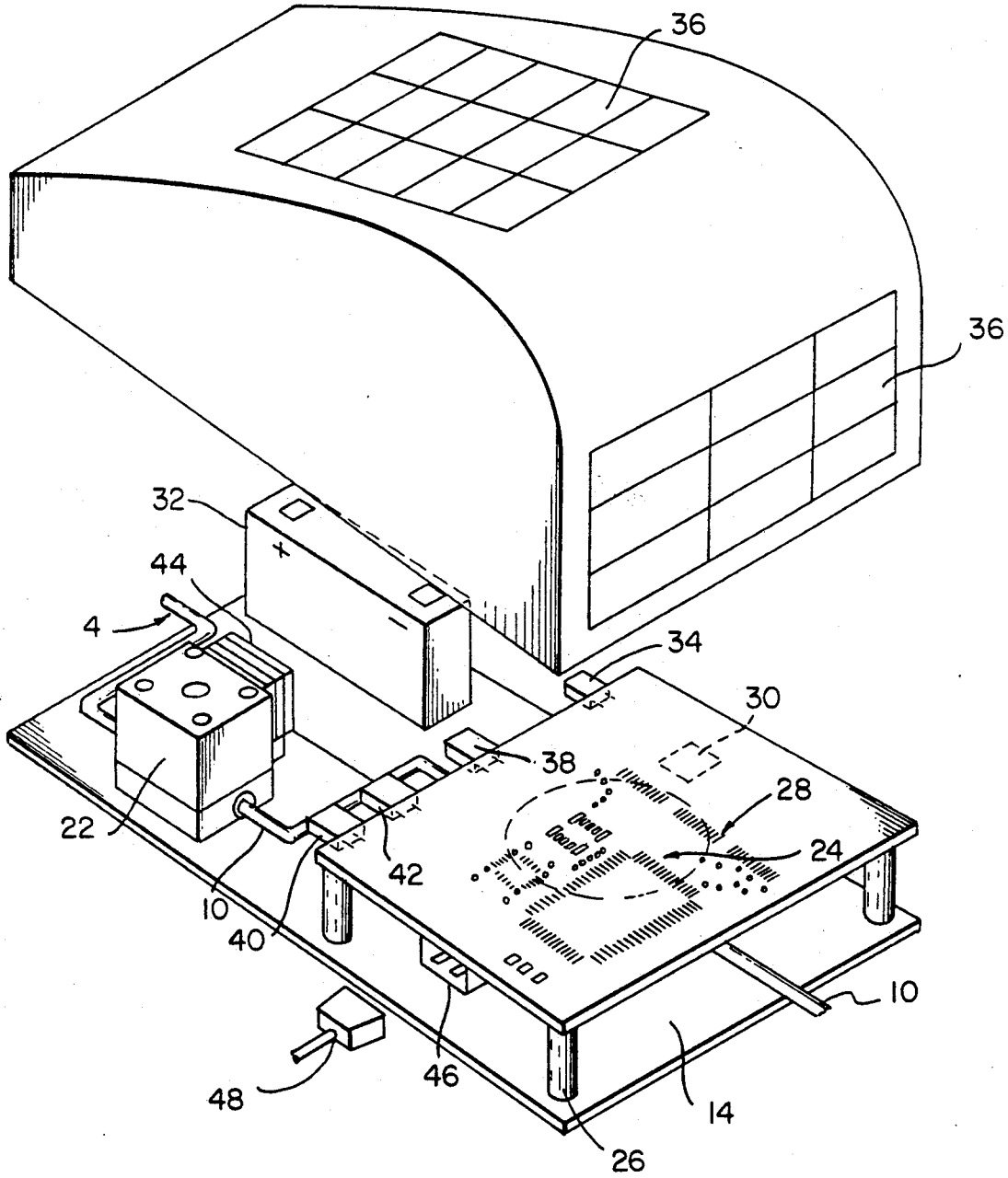
FIG. 6 is a partially exploded perspective view of the valve and valve control circuit arranged in the housing of the cooling apparatus.

As shown generally in FIGS. 1-3, the condenser coil cooling apparatus 2 of the present invention includes a fluid supply line 4, which may be connected with a fluid source such as a water spigot, a housing 6 containing the fluid flow control mechanisms, and one or more spray nozzles 8 arranged at the end of a fluid outlet line 10 from the housing.

As shown in FIG. 5, the housing 6 has a plurality of magnets 12 connected with the bottom wall 14 thereof for removably connecting the housing with an metal surface. In the example shown in FIG. 1, the housing is placed vertically on a canister style condenser 16 while in FIG. 2, the housing is arranged horizontally on a rectangular condenser unit 18. In each embodiment, the magnets at the bottom of the housing connect the housing with the condenser unit. Of course, other mounting devices such as brackets may be used.

There is shown in FIG. 3 the cooling apparatus housing 6 mounted horizontally on a large commercial condenser 20. This embodiment differs from that of FIGS. 1 and 2 in that a plurality of spray nozzles 8 are provided. In each embodiment, it is important that the spray nozzles be positioned adjacent to the coils of the condenser to direct a fine spray mist of water or other suitable fluid onto the coils to cool them while the condenser is operating. The larger the condenser, the greater the number of spray nozzles provided.

Although not shown in the drawing, the cooling apparatus of the present invention can easily be adapted for use in connection with window type air conditioners as well as specially designed units such as those for recreational vehicles. The apparatus may also be used with other refrigeration devices.

The flow control mechanism of the cooling apparatus according to the invention will be described with reference to FIG. 6. As shown therein, a solenoid valve 22 is mounted on the bottom wall 14 of the housing. The valve 22 is connected at one end with the fluid supply line 4. The fluid outlet line 10 is connected with the other side of the valve. The solenoid valve is electrically operable to shift between open and closed positions to start and stop the flow of fluid from the supply line 4 to the outlet line 10.

Control of the solenoid valve is provided by a valve control circuit board assembly 24 mounted on the housing bottom wall by spacers 26. The circuit board has a conventional pulse circuit 28 and a vibration transducer 30 mounted on the undersurface thereof. The vibration transducer produces control signals in response to sensed vibrations. Since the housing is mounted on the condenser, it vibrates when the condenser vibrates. These vibrations, and the absence of these vibrations, are sensed by the transducer to produce the control signals. Accordingly, when the condenser is turned on, it vibrates resulting in a first control signal from the transducer. When the condenser is turned off, the vibrations cease, resulting in a second control signal from the transducer.

The control signals from the vibration transducer are delivered to the pulse circuit 28 which produces switching pulses to open the solenoid valve when vibrations are sensed and to close the valve when vibrations are terminated.

A power supply is necessary to operate the solenoid valve, the transducer, and the pulse circuit. Accordingly, a battery 32 is mounted on the housing bottom wall 14 to supply power to the circuit board assembly 24 via a connector 34. Auxiliary power many also be provided to the circuit board assembly from solar collectors 36 provided on the outer surface of the housing as shown in FIGS. 4 and 6. The solar collectors supply power to the circuit board assembly via a connector 38.

Power and pulse signals are supplied to the solenoid valve from the circuit board assembly via a connector 40. Auxiliary connectors may also be provided for the circuit board assembly. For example, connector 42 is provided for a small heater 44, and a recharging connector 46 is provided for an AC plug 48. The heater is provided to prevent the cooling apparatus from freezing in the event of an early frost. Of course, once the air conditioning condenser is turned off at the end of the cooling season, the cooling apparatus is removed from the condenser and stored for the winter. Cables from the connectors 34, 38, 40, 42 to the associated devices are necessary but have been omitted from the drawing for clarity.

At the remote end of the fluid supply line 4 is provided a filter and pressure regulator assembly 50 which is shown in FIG. 7. This assembly is connected with one branch of a Y-connector 52 having a threaded end 54 adapted for connection with a water source such as a spigot or hose bib. The other branch of the Y-connector is adapted for receiving a hose and includes a conventional shut-off valve 56.

The assembly 50 includes a pressure reducing mechanism 58 including a disk 60 containing a plurality of holes through which the water passes. A spring 62 biases the pressure reducing mechanism against a seat (not shown) of the Y-connector. Beneath the spring is a water chamber 64 which delivers water to the interior of an axially arranged filter 66. The filter removes particulates from the water which passes from the filter into the supply line 4. By filtering the water, the spray nozzles are less likely to become clogged.

As set forth above, installation of the cooling apparatus of the present invention is quite simple. The filter and pressure regulator assembly 50 is connected with a spigot and the housing is attached to the condenser whose coils are to be cooled with the spray nozzles arranged adjacent to the coils.

With the present invention, there is no messy run-off of water because, unlike prior art of the heat sensor design, the unit's valve is closed completely when the air conditioner condenser is not in operation. Scale build up can become a problem with some of the other design types of cooling apparatuses because the water flow is not stopped completely when the condenser is not in operation. Because the condenser is cool during this period, evaporation of the mist does not take place and a scale is formed. This scale insulates the coils and inhibits the condenser from running efficiently. Other models of the prior art actually go inside the coils of the condenser to aid in cooling. This voids the condenser warranty and may shorten the life of the condenser. The unit of the present invention is self contained and therefore does not void the warranty of the condenser. Also, due to the fact that the condenser is in operation less but is running more efficiently, the life of the condenser is increased.

While in accordance with the provisions of the patent statute the preferred forms and embodiments of the invention have been illustrated and described, it will be apparent to those skilled in the art that various changes and modifications may be made without deviating from the inventive concepts set forth above.

What is claimed is:

1. Apparatus for cooling the condenser coils of an air conditioner, comprising (a) a housing adapted for mounting on the air conditioner;

(b) a low pressure fluid supply connected with said housing;

(c) valve means arranged in said housing and connected with said low pressure fluid supply and operable between open and closed positions to deliver and interrupt the flow of fluid from said supply, respectively;

(d) valve control means arranged in said housing and connected with said valve means for opening and closing said valve means, said valve control means including a vibration transducer which senses vibration of the condenser when the condenser is operating, said transducer producing a first signal in response to initiation of sensed condenser vibration to open said valve means and a second signal in response to termination of sensed condenser vibrations to close said valve means when the condenser is inoperative;

(e) a self-contained power supply arranged within said housing and connected with said valve control means; and (f) nozzle means connected with said valve means and arranged adjacent the coils for spraying a fluid mist on the coils when said valve means is in the open position, said fluid mist cooling the condenser coils when the condenser is operating, thereby increasing the efficiency of the condenser.

2. Apparatus as defined in claim 1, wherein said fluid supply includes filter means for removing particulates from the fluid.

3. Apparatus as defined in claim 2, wherein said fluid supply further includes a pressure reducer for reducing the pressure of the fluid.

4. Apparatus as defined in claim 3, wherein said power supply comprises a battery.

5. Apparatus as defined in claim 4, wherein said power supply further comprises a solar collector.

6. Apparatus as defined in claim 1, wherein said valve control means further includes a pulse circuit which responds to said control signal to control opening and closing of said valve means.

7. Apparatus as defined in claim 6, wherein said housing includes means for removably connecting said housing with the condenser.

8. Apparatus as defined in claim 7, wherein said fluid supply includes a filter for removing particulates from the fluid and a pressure reducer for reducing the pressure of the fluid.

* * * * *